US007735165B2

(12) United States Patent
Stryker et al.

(10) Patent No.: US 7,735,165 B2
(45) **Date of Patent: *Jun. 15, 2010**

(54) SINGLE STEP WHEELCHAIR TRANSFER DEVICE

(75) Inventors: Martin W. Stryker, Kalamazoo, MI (US); Jeffrey L. Lewandowski, Delton, MI (US); James T. Thwaites, Delton, MI (US); Cory P. Herbst, Shelbyville, MI (US)

(73) Assignee: Stryker Corporation, Kalamazoo, MI (US)

( * ) Notice: Subject to any disclaimer, the term of this patent is extended or adjusted under 35 U.S.C. 154(b) by 751 days.

This patent is subject to a terminal disclaimer.

(21) Appl. No.: 11/604,584

(22) Filed: Nov. 27, 2006

(65) Prior Publication Data

US 2007/0124859 A1 Jun. 7, 2007

Related U.S. Application Data

(60) Provisional application No. 60/741,203, filed on Dec. 1, 2005.

(51) Int. Cl.
*A61G 7/015* (2006.01)
*A61G 7/10* (2006.01)

(52) U.S. Cl. ..... 5/86.1; 5/616; 5/617

(58) Field of Classification Search ..... 5/614, 5/616–618, 620, 624, 648, 86.1
See application file for complete search history.

(56) References Cited

U.S. PATENT DOCUMENTS 697,735 A 4/1902 Magoun
1,743,255 A 1/1930 Vervoort
2,133,423 A 10/1938 Burrow
2,472,675 A 6/1949 Mueller
2,502,929 A 4/1950 Clark
2,673,987 A 4/1954 Upshaw
3,724,022 A 4/1973 Alberti et al.
3,880,481 A 4/1975 George
4,045,096 A 8/1977 Lidov
4,255,823 A * 3/1981 Boyer et al. ..... 5/87.1
4,432,359 A * 2/1984 James ..... 5/87.1
4,510,633 A 4/1985 Thorne
4,715,460 A 12/1987 Smith
4,733,737 A 3/1988 Falamak
5,001,789 A 3/1991 Schoenberger
D318,219 S 7/1991 Guile
5,097,565 A 3/1992 Shorey
5,374,879 A 12/1994 Pin et al.

(Continued)

*Primary Examiner*—Michael Trettel
(74) *Attorney, Agent, or Firm*—Van Dyke, Gardner, Linn & Burkhart, LLP

(57) ABSTRACT

A wheelchair transfer device is configured for moving an invalid patient from a flat surface to a seated position for transport in the seated position on the transfer device. The transfer device includes a rolling base supported by casters and convertible low profile rollers that are configured to fit under the base of a hospital bed and convert to a larger diameter wheel without altering the height of the transfer device. The transfer device includes a leg portion, a torso portion and a seat portion configured to be coplanar for adaptation to a hospital bed, so that an invalid patient can, with assistance, roll onto the device. The seat portion can then be raised against the patient's buttocks, generally perpendicular to the leg and torso portions, and the whole assembly can then be rotated to a vertical position, with the seat portion supporting the weight of the patient.

22 Claims, 9 Drawing Sheets

U.S. PATENT DOCUMENTS

| | | | | |
|---|---|---|---|---|
| 5,412,838 | A | 5/1995 | Yang | |
| 5,423,195 | A | 6/1995 | Peters | |
| 5,619,762 | A | 4/1997 | Mein | |
| 5,694,662 | A | 12/1997 | Bordeleau | |
| 5,916,085 | A | 6/1999 | Wells | |
| 6,131,215 | A * | 10/2000 | Lindell | 5/86.1 |
| 6,173,461 | B1 * | 1/2001 | Alexander | 5/618 |
| 6,195,838 | B1 | 3/2001 | Mains et al. | |
| 6,223,388 | B1 | 5/2001 | Sey | |
| 6,230,343 | B1 | 5/2001 | Buiskool et al. | |
| 6,289,536 | B1 * | 9/2001 | Betson | 5/618 |
| 6,502,280 | B2 | 1/2003 | Looker | |
| 6,691,349 | B2 | 2/2004 | Blevins | |
| 7,406,730 | B2 * | 8/2008 | Sundstrom | 5/617 |
| 7,441,786 | B2 * | 10/2008 | Stryker et al. | 280/79.11 |
| 2004/0021278 | A1 | 2/2004 | Lyden | |

* cited by examiner

SINGLE STEP WHEELCHAIR TRANSFER DEVICE

CROSS-REFERENCE TO RELATED APPLICATIONS

This application claims the benefit of U.S. Provisional Application Ser. No. 60/741 203, filed Dec. 1, 2005, which is incorporated herein in its entirety.

FIELD OF THE INVENTION

The invention relates to patient transfer devices for moving a patient from a recumbent position to a seated position.

BACKGROUND OF THE INVENTION

Patients often require assistance in moving from a hospital bed to a wheelchair, or require assistance in moving from the hospital bed to a toilet. An attendant rendering assistance is subject to injury in assisting the patient without mechanical assistance. Patient transfer devices can still require excessive bending and lifting by an attendant, increasing the likelihood of injury to the attendant or patient. In the alternative, some patient transfer devices, such as an overhead lift, can make the patient feel like freight due to the lack of any personal contact by an attendant.

It would be advantageous to provide a patient transfer device that gives an attendant the mechanical advantage necessary to move a patient without injury, and that maintains the close personal contact between the patient and the medical attendant.

BRIEF DESCRIPTION OF THE DRAWINGS

The present invention will become more fully understood from the detailed description and the accompanying drawings, wherein.

DETAILED DESCRIPTION OF THE INVENTION

Figure 2:
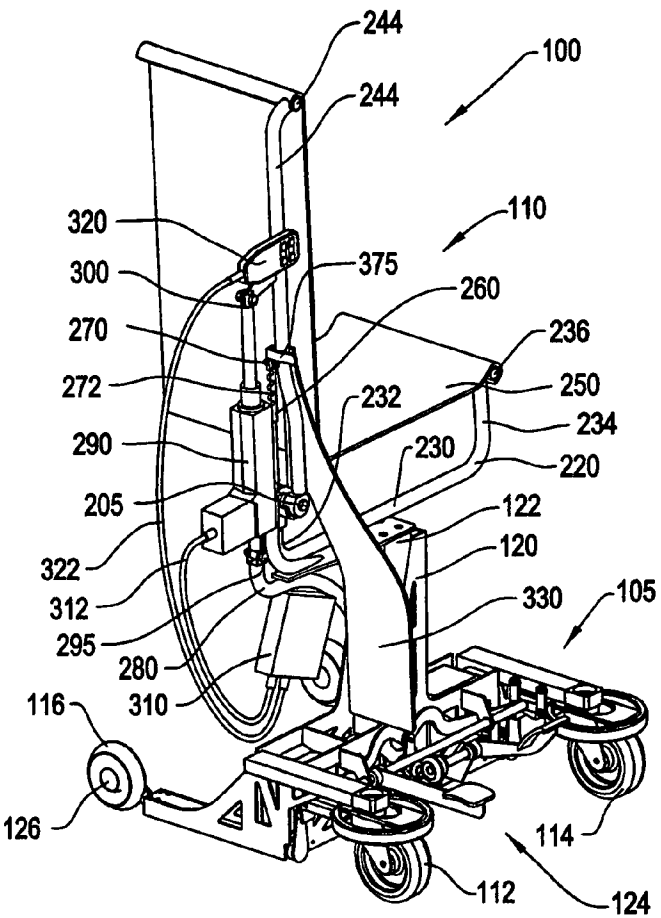
FIG. 2 is a further perspective view of the patient transfer device of FIG. 1.

Certain terminology will be used in the following description for convenience and reference only, and will not be limiting. For example, the words "upwardly", "downwardly", "rightwardly" and "leftwardly" will refer to directions in the drawings to which reference is made. The words "inwardly" and "outwardly" will refer to directions toward and away from, respectively, the geometric center of the arrangement and designated parts thereof. Said terminology will include the words specifically mentioned, derivatives thereof, and words of similar import.

Figure 1:
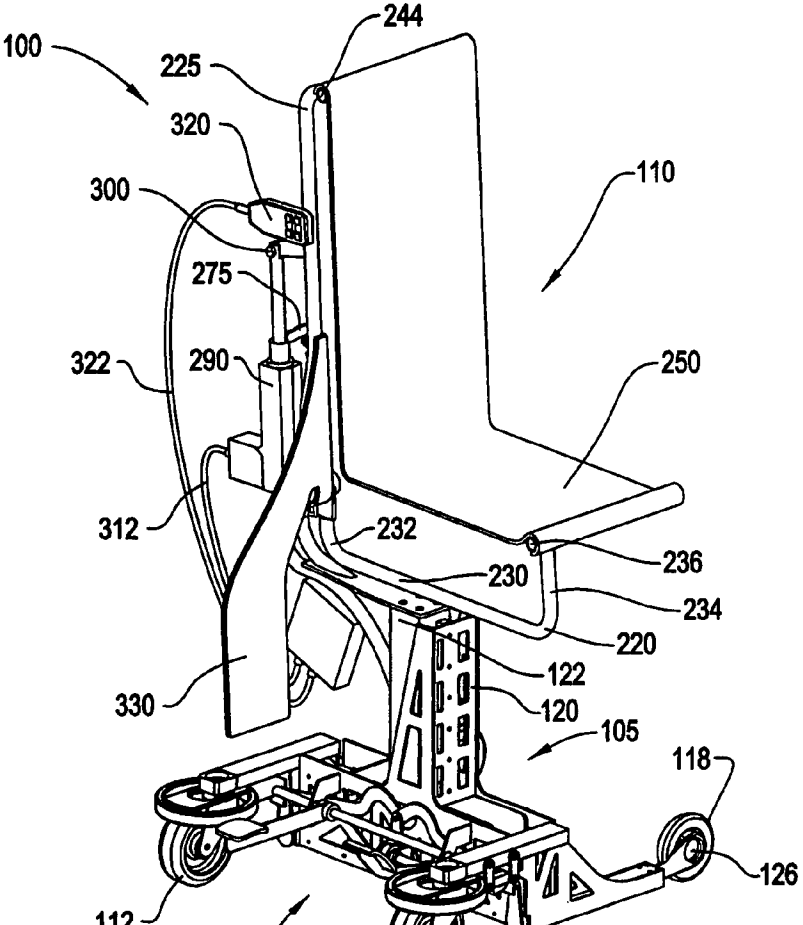
FIG. 1 is a perspective view of a patient transfer device according to the invention.
Figure 3:
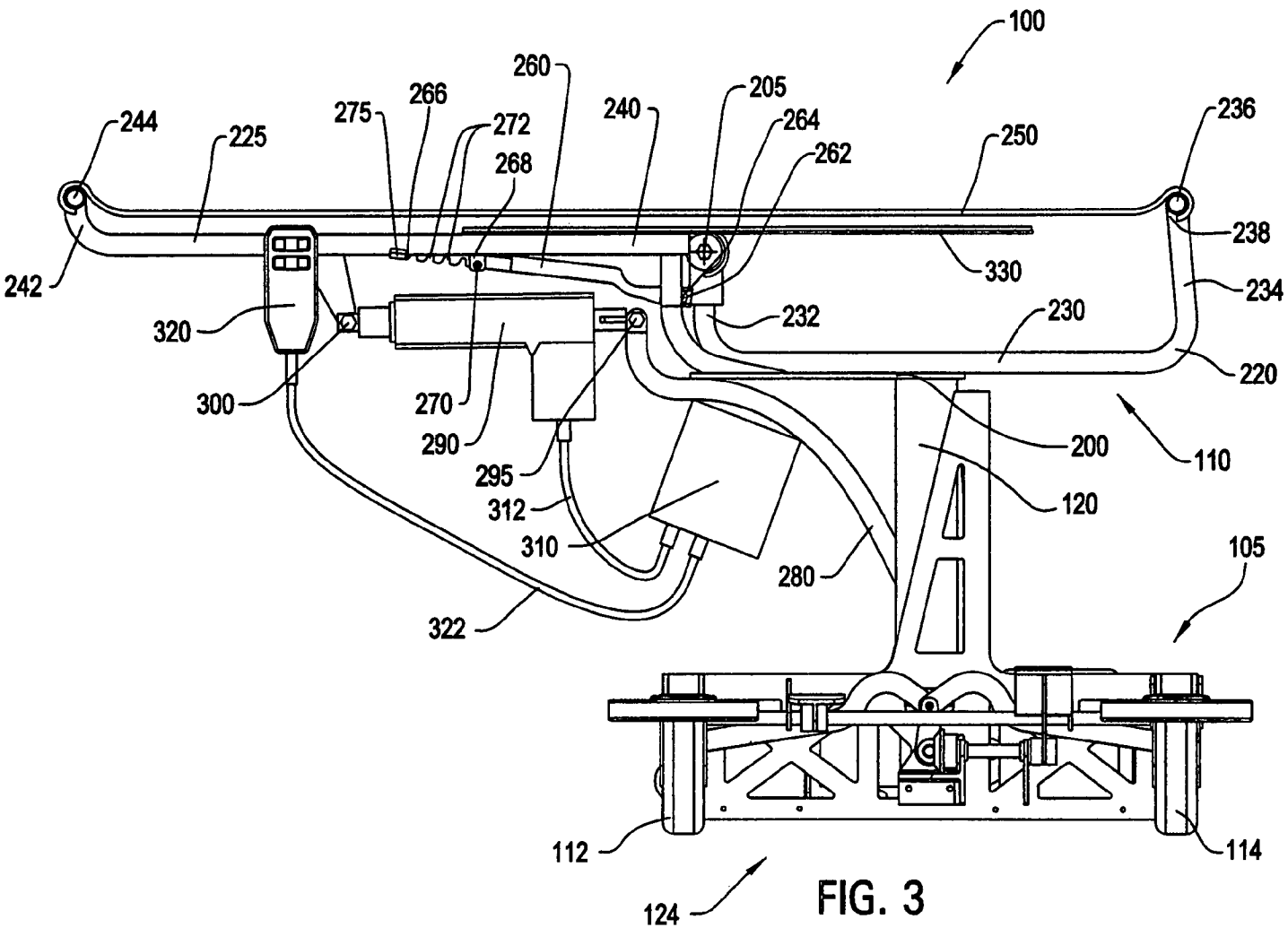
FIG. 3 is a front view of the patient transfer device of FIGS. 1-2 in a reclined position.

Referring to FIGS. 1-3, the device 100 includes a rolling base unit 105 and an upper unit 110. The rolling base unit 105 includes a pair of caster wheels 112, 114 and a pair of dual height roller wheels 116, 118. An adjustable height stanchion 120 projects upwardly from the rolling base unit 105. The upper unit 110 is secured to an upper end 122 of the stanchion 120. FIGS. 1-2 provide perspective views of the device 100 with the upper unit 110 in an upright seating position. FIG. 3 is a side view of the device 100 with the upper unit 110 in a prostrate position.

The rolling base unit 105 further includes an adjustment mechanism 124. The adjustment mechanism 124 selectively rotates the dual height roller wheels 116, 118 from a raised position (FIG. 1), wherein the base unit 105 is supported on the rolling surfaces of the wheels 116, 118, to a lowered position (FIG. 10) offset from the raised position by 90 degrees, wherein the base unit 105 is supported by a roller bearing 126 mounted in the center of each roller wheel 116, 118. This operation is described in greater detail in commonly owned U.S. Ser. No. 11/354 801, filed Feb. 15, 2006, which is incorporated herein by reference in its entirety.

The upper unit 110 includes a frame support member 200 that is secured to the upper end 122 of the stanchion 120. The frame support member 200 supports a pivot pin 205 defining a pivot axis 210. A pivoting wheelchair frame 215 is pivotally mounted to the frame support member 200 by the pivot pin 205 and is configured to pivot about the pivot axis 210.

The frame 215 is formed of two major components, a seat frame 220 and an upper torso support frame 225. The seat frame 220 and the upper torso support frame 225 are each independently pivotally mounted to the support member 200 to rotate about the pivot axis 210.

The seat frame 220 is formed of a generally U-shaped tubular member 230 having inner and outer legs 232, 234. The inner leg 232 is pivotally connected to the support member 200. A transverse seat support member 236 is attached at the uppermost extent 238 of the outer leg 234.

The upper torso support frame 225 is attached to the support member at an inner end 240. The frame 225 includes an upturned outer end 242. A transverse seat support member 244 is attached to the frame 225 at the outer end 242. A flexible seat body 250 extends between the transverse seat support members 236, 244.

The seat frame 220 and the upper torso support frame 225 are joined by an attitude fixing mechanism 260. The attitude fixing mechanism 260 is pivotally mounted at a first end 262 to the seat frame 220 by a pivot pin 264. A second end 266 of the attitude fixing mechanism 260 is selectively fixable on the upper torso support frame 225. The frame 225 includes a yoke 268 having a through-pin 270. The second end 266 of the attitude fixing mechanism 260 includes a plurality of recesses 272. The attitude fixing mechanism 260 is receivable within the yoke 268 in such a manner that the pin 270 is positioned to selectively engage one of the plurality of recesses 272. The fixing mechanism 260 further includes a spring clip 275 positioned proximate the second end 266 and configured to bear against the frame 225 for urging the fixing mechanism 260 away from the frame 225, and thus urging the pin 270 into a respective one of the plurality of recesses 272.

A second frame support member 280 is rigidly attached to the stanchion 120. The support member 280 supports a drive mechanism 290. The drive mechanism 290 is pivotally connected to the support member 280 at a lower pivot 295 and to the upper torso support frame 225 at an upper pivot 300. In the illustrated embodiment, the drive mechanism 290 is an electric drive mechanism, but hydraulic, pneumatic or other mechanical drive types are also anticipated.

The drive mechanism 290 is electrically connected to a controller/battery module 310 by a control cable 312. The controller/battery module 310 is suspended from the support member 280. A remote control switch panel 320 is provided and is shown mounted on the upper torso support frame 225. The remote control switch panel 320 is further electrically connected to the controller/battery module 310 by a further control cable 322.

A knee-board 330 is mounted to the upper torso support frame 225. The knee-board 330 is rigidly mounted to the frame 225 and is mounted parallel thereto.

Figure 4:
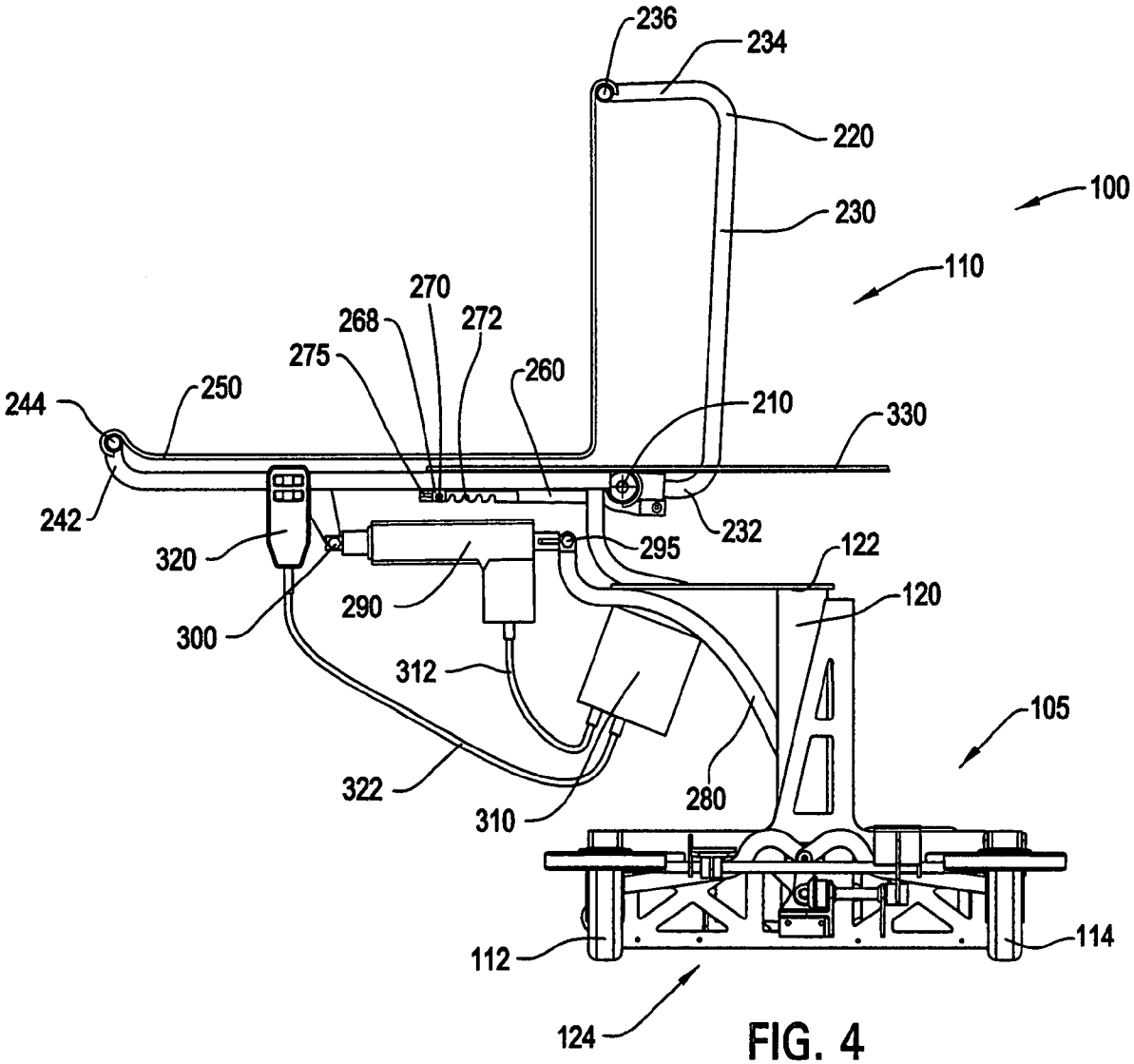
FIG. 4 is a front view of the patient transfer device of FIGS. 1-3 in a reclined position with a seat portion raised.

Referring to FIG. 4, the seat portion 220 has been rotated counterclockwise 90 degrees about the pivot axis 210. As the seat portion 220 rotates counterclockwise about the pivot axis 210, independent of the upper torso support frame 225, the fixing mechanism 260 is drawn through the yoke 268. The recesses 272 sequentially line up with the pin 270, enabling the seat portion 220 to be selectively locked in multiple angular positions with respect to the upper torso support frame 225. As the seat portion 220 reaches the 90 degree rotation shown in FIG. 4, the endmost recess 272 reaches the pin 270 in the yoke 268. With the pin 270 lodged in the endmost recess 272, the seat portion 220 is secured in a 90 degree relationship to the upper torso support frame 225.

Figure 6:
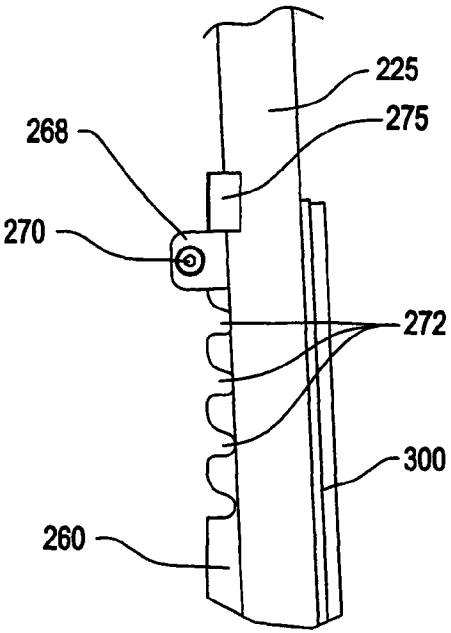
FIG. 6 is an enlarged detail view according to FIG. 5.
Figure 5:
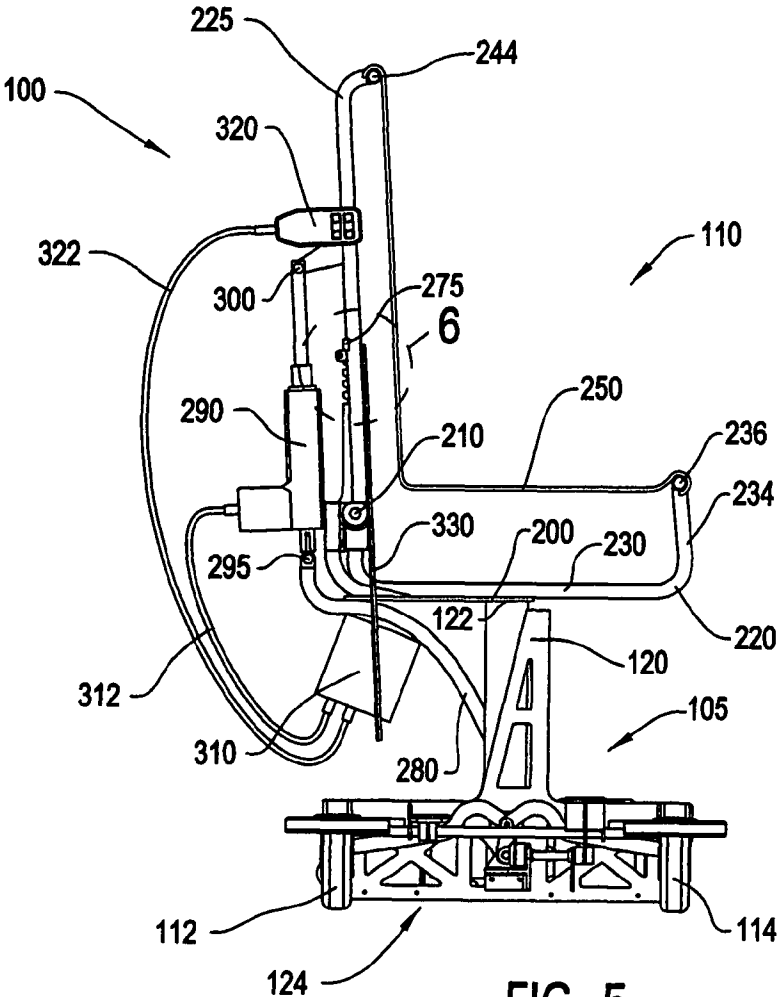
FIG. 5 is a front view of the patient transfer device of FIGS. 1-4 in an upright position.

Referring now to FIGS. 5-6, the device 100 is shown with the upper unit 110 in the upright seated position. The upper torso support frame 225 and the seat portion 220 are rotated together into the upright position. In this position, the seat portion 220 is supported by the frame support member 200 on the stanchion 120. The upper torso support frame 225 is supported in the upright position by the drive mechanism 290. As shown in FIG. 5, the drive mechanism 290 is in an extended condition. Since the drive mechanism 290 pivots about the lower pivot 295 and the upper pivot 300, which are offset from the pivot axis 210, the extension of the drive mechanism 290 forces the upper torso support frame 225 to pivot about the pivot axis 210.

Operation

Figure 7:
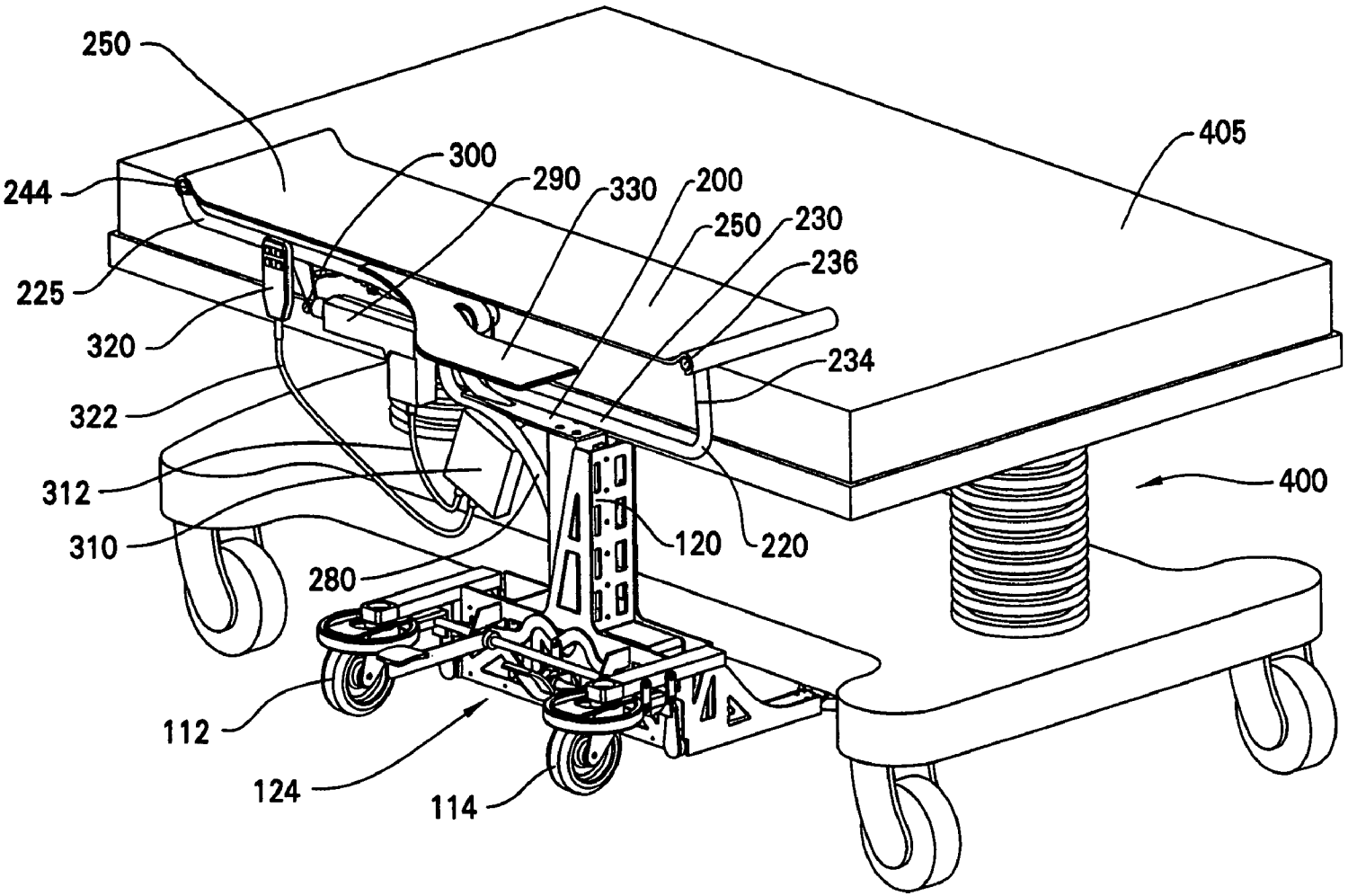
FIG. 7 is a perspective view of the patient transfer device of FIGS. 1-6 adjacent a hospital bed, in the reclined position.

The device 100 is configured for raising a patient from a reclining position to a seated position. Referring first to FIG. 7, the device 100 is positioned adjacent to a bed 400 with the upper unit 110 in the prostrate position. In this position, the seat body 250 is horizontal and is positioned at the height of the patient support surface 405 of the bed 400 using the adjustable height stanchion 120. As necessary, the dual height wheels 116, 118 are placed in the low profile position to roll under the base of the bed 400, and the device 100 is rolled to the bed 400 so that the seat body 250 overlies a portion of the patient support surface 405. In the configuration of the single step wheelchair transfer device 100 illustrated herein, the device 100 is rolled to the "left" side of the bed 400; the patient's head is also to the left as viewed from beside the bed 400. In a further configuration (not shown), the device 100 is configured to roll to the "right" side of the bed 400; this is advantageous where access to the left side of the bed 400 is restricted, or where the patient is laying with his head to the right from the perspective of the device 100. In a further embodiment, the device is capable of being selectively configured in either the "left" side or "right" side configurations, thereby providing the attendant with the flexibility to operate in different room and equipment layouts using one single step wheelchair transfer device 100.

Typically, the patient will be rolled away from the device 100, and the device 100 rolled over the portion of the patient support surface 405 previously occupied by the patient. The patient is then rolled back onto the positioned device 100. The patient is then further rolled toward the device 100 until the patient is lying on his side on the seat body 250. The patient's legs are then drawn outward until the patient's knees and lower legs are resting on the knee-board 330.

Figure 8:
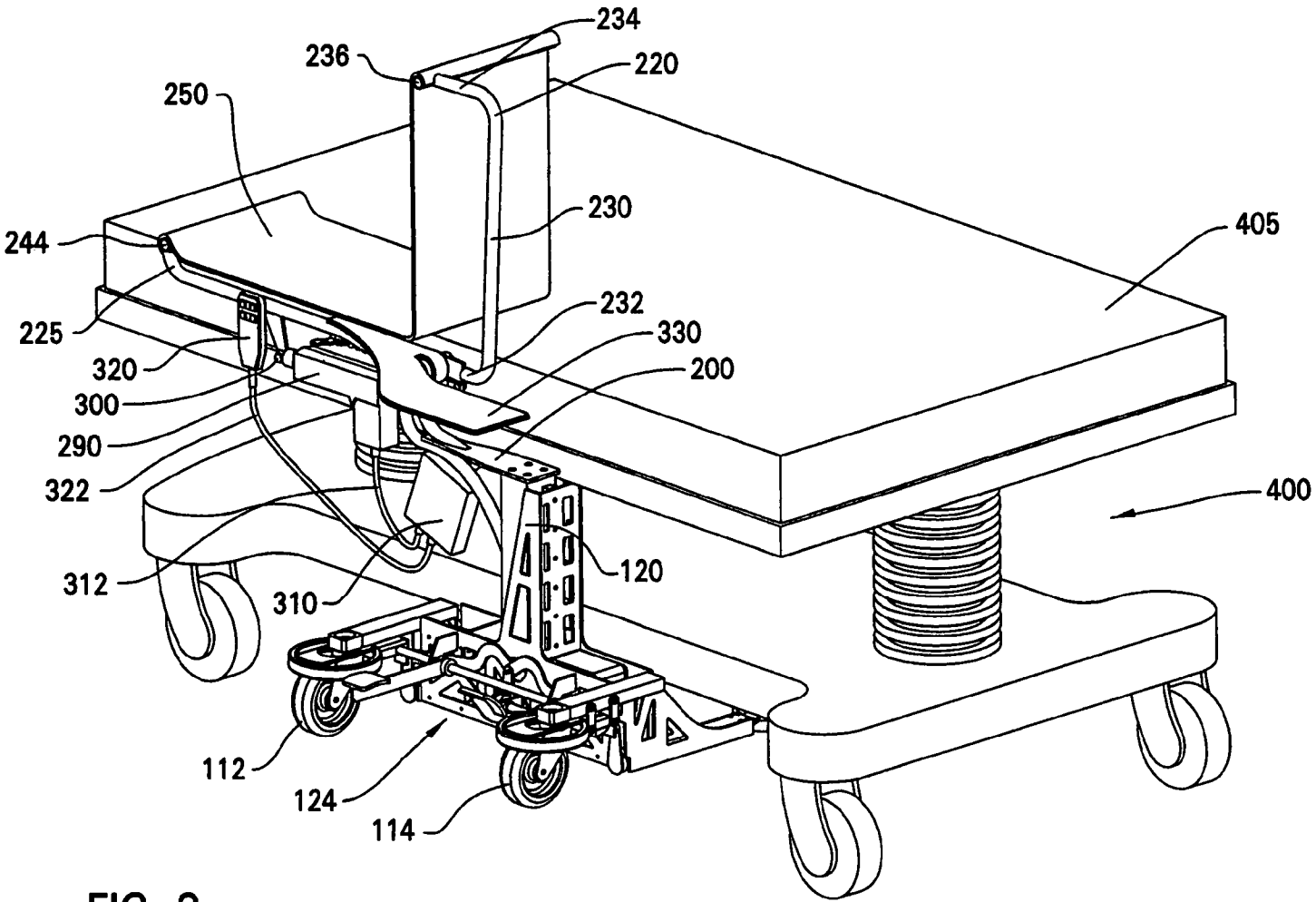
FIG. 8 is a perspective view of the patient transfer device of FIGS. 1-7 adjacent a hospital bed, in the seat raised position.

Referring now to FIG. 8, the seat portion 220 of the upper unit 110 is rotated upwardly until it reaches the upright position, 90 degrees from the patient support surface 405. The seat portion 220 is automatically locked in the 90 degree position as the fixing mechanism 260 slides through the yoke 268 until the pin 270 engages the last recess 272 on the fixing mechanism 260. With the seat portion 220 in this position, the seat body 250 contacts the buttocks and the backs of the upper thighs of the patient.

Figure 9:
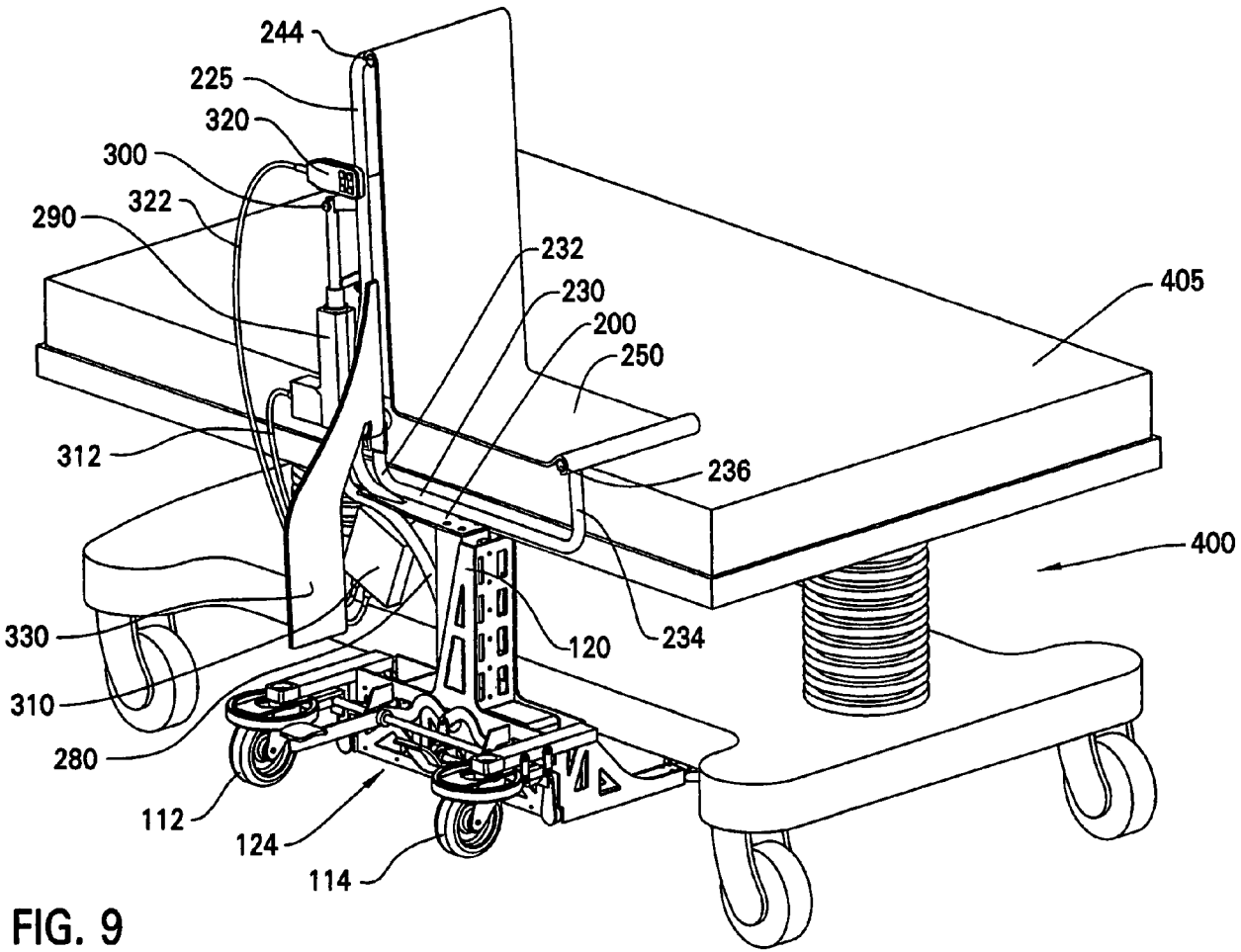
FIG. 9 is a perspective view of the patient transfer device of FIGS. 1-8 adjacent a hospital bed, in the upright position.

The device is now ready to be moved to the upright seated position. An attendant will use the remote control switch to activate the drive mechanism 290. As the drive mechanism 290 is activated and drives from a retracted position to an extended position (see also FIG. 5), the upper unit 110 rotates from the prostrate position to the upright seated position shown in FIG. 9. The knee-board 330 is fixed to the upper torso support frame 225 and rotates therewith, supporting the patient's knees and lower legs through the rotation cycle as the upper unit 110 comes to the upright position. The patient is now raised to the position of sitting on the edge of the patient support surface 405.

Figure 10:
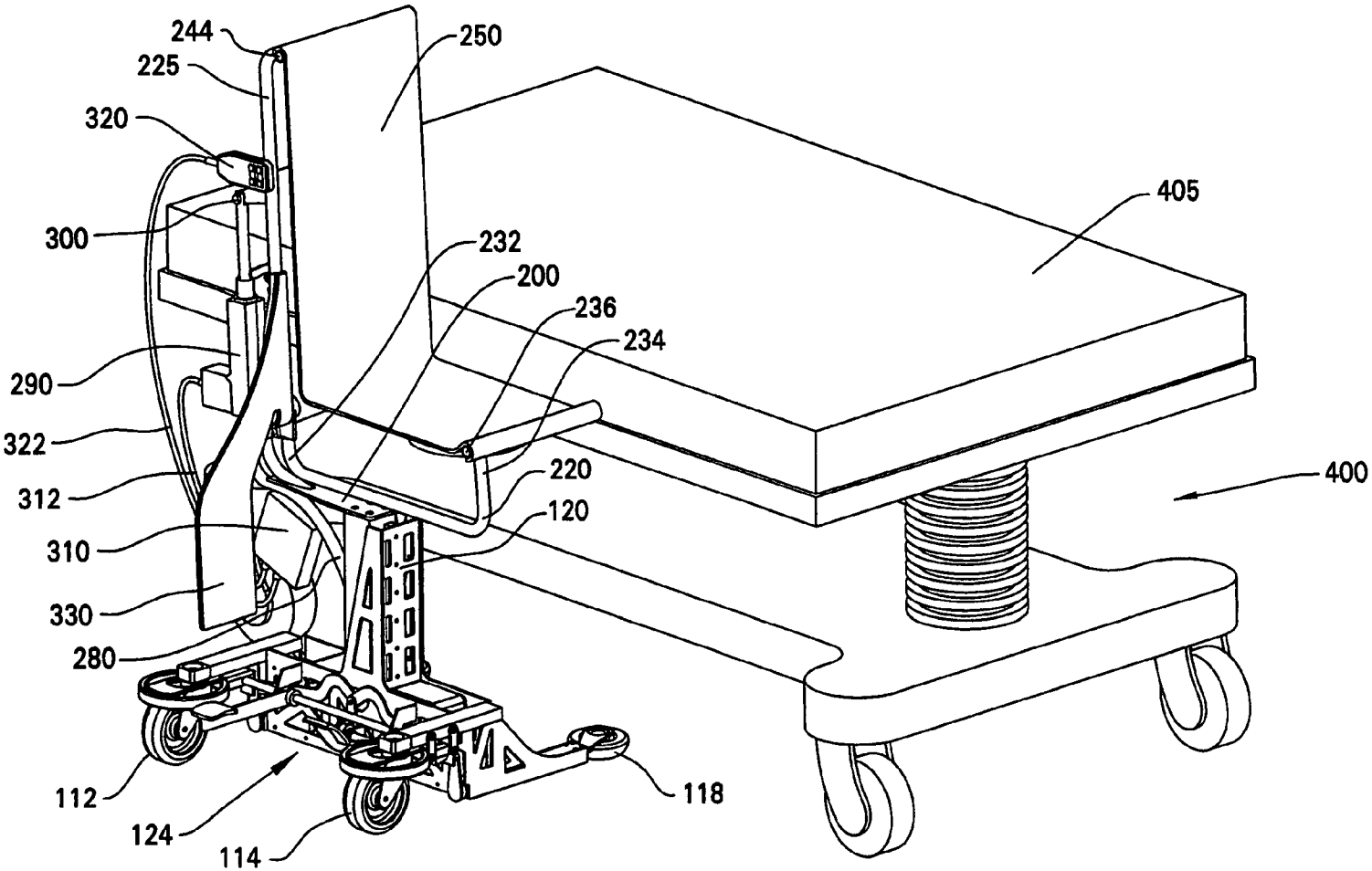
FIG. 10 is a perspective view of the patient transfer device of FIGS. 1-9 adjacent a hospital bed, with the base in a positioning configuration.
Figure 11:
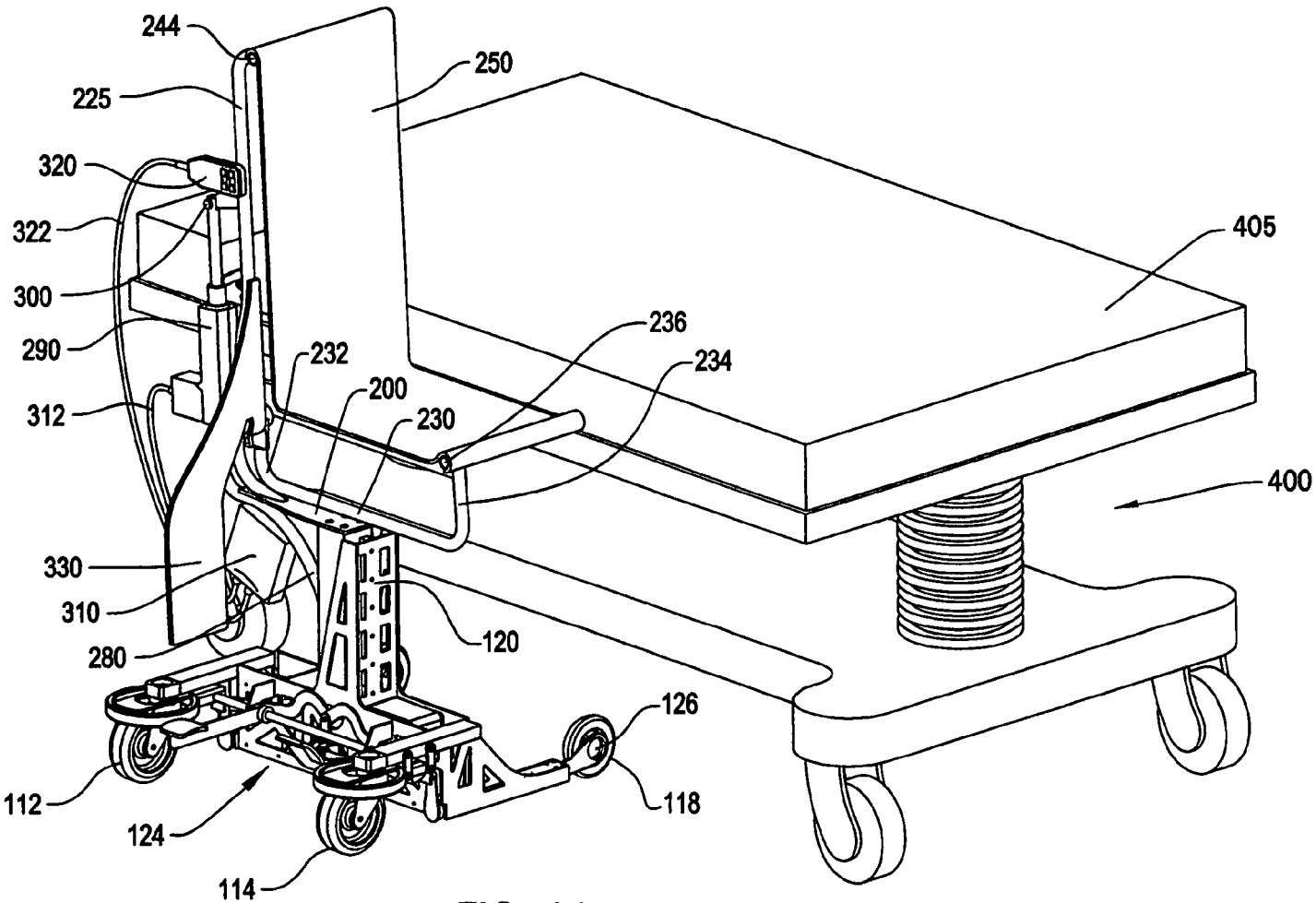
FIG. 11 is a perspective view of the patient transfer device of FIGS. 1-10 adjacent a hospital bed, with the base in a transporting configuration.

FIGS. 10-11 illustrate the movement of the device 100 away from the bed 400. Safety belts (not shown) can be provided to secure the patient to the device 100, who is otherwise closely attended by an attendant. In FIG. 10, the dual height wheels 116, 118 are in the low profile position for maneuvering under the base of the bed. In FIG. 11, the dual height wheels have been rotated to the high profile position, better suited for transporting a patient over longer distances or uneven surfaces. In this configuration, the device can be used directly as a wheelchair for special purpose movement, such as for transporting a patient to the bathroom. The device 100 can also be made waterproof for use directly in the shower, eliminating the need to lift or move the patient again once the patient has been lifted and carried by the device 100.

While the invention has been described in the specification and illustrated in the drawings with reference to a preferred embodiment, it will be understood by those skilled in the art that various changes may be made and equivalents may be substituted for elements thereof without departing from the scope of the invention as defined in the claims. In addition, many modifications may be made to adapt a particular situation or material to the teachings of the invention without departing from the essential scope thereof. Therefore, it is intended that the invention not be limited to the particular embodiment illustrated by the drawings and described in the specification as the best mode presently contemplated for carrying out this invention, but that the invention will include any embodiments falling within the scope of the appended claims.

What is claimed is:

1. A wheelchair transfer device comprising:

a base portion; and a patient support portion supported by the base portion, the patient support portion being convertible from a generally horizontal reclined position to an upright position and including a seat portion and a torso support portion, the seat portion being configured for pivoting from the generally horizontal reclined position to a raised position while the torso portion remains in the generally reclined position and pivoting back to the generally horizontal reclined position simultaneously with the torso support portion of the patient support portion raising from the generally horizontal reclined position to an upright position to form a seat, said patient support portion comprising a flexible body having a continuous surface forming said seat portion and said torso portion.

2. The wheelchair transfer device according to claim 1, further comprising a frame, the frame supporting the flexible body and a knee-board, the knee-board being generally coplanar and laterally adjacent the flexible body when the patient support portion is in the generally horizontal reclined position.

3. The wheelchair transfer device according to claim 1, further comprising a frame, the frame supporting and suspending the flexible body at opposed ends of the flexible body above the frame.

4. The wheelchair transfer device according to claim 3, wherein said continuous surface extends between the opposed ends of the flexible body.

5. A wheelchair transfer device for raising a patient from a prone position to a seated position, the transfer device comprising:

a mobile base unit; and a patient support unit mounted on the mobile base unit for positioning adjacent a patient support surface, the patient support unit comprising:

a pivotal seat frame pivotal for rotation between a horizontal position and a vertical position;

a torso support frame pivotally mounted to the seat frame and being pivotal for rotation between a horizontal position and a vertical position;

a knee-board being connected to the torso support frame;

a fixing mechanism positioned between the seat frame and the torso support frame for selectively locking an angular orientation therebetween; and a flexible seat body connected at a first end to the seat frame and at a second end to the torso support frame.

6. A wheelchair transfer device for raising a patient from a prone position to a seated position, the transfer device comprising:

a mobile base unit; and a patient support unit mounted on the mobile base unit for positioning adjacent a patient support surface, the patient support unit comprising:

a pivotal seat frame pivotal for rotation between a horizontal position and a vertical position;

a torso support frame pivotally mounted to the seat frame and being pivotal for rotation between a horizontal position and a vertical position;

a knee-board being connected to the torso support frame; and a fixing mechanism positioned between the seat frame and the torso support frame for selectively locking an angular orientation therebetween;

wherein the fixing mechanism is pivotally mounted to one of the seat frame and the torso support frame and the fixing mechanism comprising a plurality of recesses configured for selectively locking the angular orientation between the seat frame and the torso support frame.

7. The A wheelchair transfer device for raising a patient from a prone position to a seated position, the transfer device comprising:

a mobile base unit; and a patient support unit mounted on the mobile base unit for positioning adjacent a patient support surface, the patient support unit comprising:

a pivotal seat frame pivotal for rotation between a horizontal position and a vertical position;

a torso support frame pivotally mounted to the seat frame and being pivotal for rotation between a horizontal position and a vertical position;

a knee-board being connected to the torso support frame;

a fixing mechanism positioned between the seat frame and the torso support frame for selectively locking an angular orientation therebetween; and a driver for selectively lowering the torso support frame between the vertical and horizontal positions when the angular orientation between the torso support frame and the seat frame is unlocked and raising the torso support frame and the seat frame to a seated position when the angular orientation between the torso support frame and the seat frame is locked.

8. The wheelchair transfer device according to claim 7, wherein the frame support member comprises a first frame support member, and further comprising a second frame support member, wherein the driver is pivotally mounted to the second frame support member.

9. The wheelchair transfer device according to claim 8, wherein the driver is pivotally mounted to the torso support frame.

10. The wheelchair transfer device according to claim 7, wherein the driver comprises one chosen from an electric drive mechanism, a hydraulic drive mechanism, and a pneumatic drive mechanism.

11. A method for operating a wheelchair transfer device having a patient support portion comprising a pivotally mounted torso support frame with an attached knee-board, a pivotally mounted seat frame selectively positionable relative to the torso support frame, with a flexible seat body extending between the torso support frame and the seat frame, the method comprising:

moving a patient onto the wheelchair transfer device, wherein said moving includes positioning the side of the patient to face the patient support portion;

placing the patient's legs onto the knee-board;

rotating the seat frame upwardly until the flexible seat body cradles the underside of the patient's upper legs, wherein the seat frame and the torso support frame are arranged at approximately 90 degrees;

locking the seat frame position relative to the torso support frame; and rotating the torso support frame and the seat frame locked therewith to move the torso support frame and the seat frame to a seated position wherein the torso support frame is in a generally vertical orientation, the seat frame being locked therewith to rotate back to the horizontal position.

12. The method according to claim 11, further comprising raising the wheelchair transfer device with the patient after the patient has been moved onto the wheelchair transfer device.

13. The method according to claim 11, further comprising lowering the patient support portion of the wheelchair transfer device onto the bed surface prior to moving the patient onto the wheelchair transfer device.

14. The method according to claim 11, further comprising providing an actuator for pivoting the torso support frame, and activating the actuator to rotate the torso support frame when raising the patient to a seated position.

15. The method according to claim 14, wherein providing an actuator comprises providing a driver, and the activating comprises powering the driver.

16. A wheelchair transfer device comprising:

a mobile base unit; and a patient support unit mounted to the mobile base unit, the patient support unit comprising a generally C-shaped frame configured to unfold about a pivot axis and in a pivot plane to an open configuration and to fold about the pivot axis in the pivot plane to a generally C-shaped configuration, the C-shaped frame having a pair of cantilevered members at opposed ends of the C-shaped frame, and the patient support unit further comprising a flexible patient support surface supported by and extending between the cantilevered members wherein the flexible patient support surface is generally planar when the C-shaped frame is unfolded, and the flexible patient support surface forms a seat configuration when the C-shaped frame is in its generally C-shaped configuration.

17. The wheelchair transfer device according to claim 16, wherein the generally C-shaped frame includes a torso support frame and a seat frame, further comprising a knee-board, the knee-board having a knee support surface, and the knee support surface being generally perpendicular to the pivot plane.

18. The wheelchair transfer device according to claim 17, wherein the knee-board is mounted to the torso support frame.

19. A wheeled transfer device comprising:

a base unit;

a member mounted to the base unit, said member having a longitudinal axis and being rotatable about said longitudinal axis;

a roller assembly mounted to the member, the roller assembly comprising:

an inner roller rotatably mounted about an axis of rotation; and an outer roller rotatably mounted about the inner roller wherein the first roller is configured to contact a floor surface when the member is in a first orientation, the second roller being configured to contact the floor surface when the member is rotated about longitudinal axis to a second orientation generally orthogonal to the first orientation, and when the first roller contacts the floor surface the member is at a first distance from the floor surface, and when the second roller contacts the floor surface the member is at a second distance generally equal to the first distance from the floor surface to thereby form a lower profile roller assembly.

20. The wheeled transfer device according to claim 19, wherein the outer roller comprises an annular roller.

21. The wheeled transfer device according to claim 20, wherein the inner roller comprises a roller ball.

22. The wheeled transfer device according to claim 19, wherein the axis of rotation comprises a first axis of rotation and the outer roller is rotatable about a second axis of rotation offset from the first axis of rotation.

* * * * *

UNITED STATES PATENT AND TRADEMARK OFFICE

CERTIFICATE OF CORRECTION

PATENT NO. : 7,735,165 B2
APPLICATION NO. : 11/604584
DATED : June 15, 2010
INVENTOR(S) : Martin W. Stryker et al.

It is certified that error appears in the above-identified patent and that said Letters Patent is hereby corrected as shown below:

Column 6
Claim 7, Line 1, Delete "The" before "A wheelchair"

Signed and Sealed this

Ninth Day of November, 2010

David J. Kappos

David J. Kappos
*Director of the United States Patent and Trademark Office*